US008248351B2

(12) United States Patent
Miyazaki

(10) Patent No.: US 8,248,351 B2
(45) Date of Patent: Aug. 21, 2012

(54) DISPLAY APPARATUS AND DRIVER

(75) Inventor: Kiyoshi Miyazaki, Kanagawa (JP)

(73) Assignee: Renesas Electronics Corporation, Kawasaki-shi, Kanagawa (JP)

( * ) Notice: Subject to any disclaimer, the term of this patent is extended or adjusted under 35 U.S.C. 154(b) by 407 days.

(21) Appl. No.: 12/656,108

(22) Filed: Jan. 15, 2010

(65) Prior Publication Data

US 2010/0182349 A1 Jul. 22, 2010

(30) Foreign Application Priority Data

Jan. 19, 2009 (JP) ..... 2009-009305

(51) Int. Cl.
*G09G 3/36* (2006.01)

(52) U.S. Cl. ..... 345/98; 345/87; 345/96; 345/100

(58) Field of Classification Search ..... 345/87–90, 345/92, 98–100, 690
See application file for complete search history.

(56) References Cited

U.S. PATENT DOCUMENTS 6,806,859 B1 * 10/2004 Kanoh et al. ..... 345/98
2003/0006997 A1 * 1/2003 Ogawa et al. ..... 345/690
2003/0132907 A1 * 7/2003 Lee et al. ..... 345/98
2003/0146909 A1 8/2003 Maki
2004/0125067 A1 * 7/2004 Kim et al. ..... 345/98

FOREIGN PATENT DOCUMENTS

JP 2003-208132 7/2003
JP 2007-163913 6/2007

* cited by examiner

*Primary Examiner* — Amare Mengistu
*Assistant Examiner* — Koosha Sharifi-Tafreshi
(74) *Attorney, Agent, or Firm* — McGinn IP Law Group, PLLC

(57) ABSTRACT

A display apparatus includes a display section; latching sections configured to receive and hold display data to be displayed on the display section; input switches respectively connected with outputs of the latching sections, D/A converters respectively connected with the input switch groups; amplifiers configured to amplify and output the output gradation voltages from the D/A converters, respectively; output switches provided between outputs of the amplifiers and an output node, respectively; data line switches provided onto data lines, respectively; and a control section configured to sequentially supply input switching control signals to the input switches, sequentially supply output switching control signals to the output switches, and sequentially supplies data line switching control signals to the data line switches in synchronization with a $Y^{th}$ clock of the input switching control signal.

8 Claims, 10 Drawing Sheets

DISPLAY APPARATUS AND DRIVER

INCORPORATION BY REFERENCE

This patent application claims a priority on convention based on Japanese Patent Application No. 2009-009305. The disclosure thereof is incorporated herein by reference.

BACKGROUND OF THE INVENTION

1. Field of the Invention

The present invention relates to a driver and a TFT type liquid crystal display apparatus using the driver to display a display data.

2. Description of Related Art

A TFT type liquid crystal display apparatus has become popular. FIG. 1 shows a configuration of the conventional TFT type liquid crystal display apparatus. The TFT type liquid crystal display apparatus contains a display panel (liquid crystal panel) 140, a gate driver (not shown), a source driver 101 and a power source circuit 130.

The liquid crystal panel 140 contains a plurality of pixels 143 that are arranged in a matrix. Each of the plurality of pixels 143 contains a thin film transistor (TFT) and a pixel capacitor. The pixel capacitor contains a pixel electrode and a counter electrode opposing to the pixel electrode. The TFT contains a drain electrode, a source electrode connected to the pixel electrode, and a gate electrode.

The liquid crystal panel 140 further contains a plurality of gate lines 142 and a plurality of data lines 141. Each of the plurality of gate lines 142 is connected to the gate electrodes of the TFTs of the pixels 143 on one row. Each of the plurality of data lines 141 is connected to the drain electrodes of the TFTs of the pixels 143 on one column.

The power source circuit 130 contains gradation resistor elements that are connected in series. In the power source circuit 130, a reference voltage is divided by the gradation resistor elements, to generate a plurality of gradation voltages.

In one horizontal period, it is assumed that the gate driver sequentially selects one gate line 142 from the plurality of gate lines 142 from the first gate line to the last gate line in response to the signal. In this case, a selection signal is outputted from the gate driver to the gate line 142 and the TFTs of the pixels 143 on the selected gate line 142 are turned on. This is similarly applied to the other gate lines 142.

A display data for one screen (one frame) corresponding to the plurality of data lines 141 from the first line to the last line and a clock signal CLK are supplied to the source driver 101. The source driver 101 selects one gradation voltage from the plurality of gradation voltages based on the display data in synchronization with the clock signal CLK, and outputs the selected gradation voltage to a corresponding data line of the plurality of data lines 141. At this time, the TFT of a selected pixel 143 connected with the corresponding gate line 142 and the corresponding data line 141 is turned on. For this reason, the gradation voltage is written into the pixel capacitor of the selected pixel 143 and held until a next write timing. Thus, the display data for one line is displayed.

In the TFT type liquid crystal display apparatus, usually, each dot of the image is composed of three pixels corresponding to the basic primary colors of red, green and blue. For example, three switches are respectively provided for the pixels of R, G and B, with respect one output of the source driver. In the TFT type liquid crystal display apparatus, the three switches are switched at a constant time interval, to allow one amplifier to drive to the three pixels. This method is called as a 3-time-divisional drive, and is described in, for example, Japanese Publication (JP 2003-208132A).

In the TFT type liquid crystal display apparatus, usually, the pixels for one line scanned or selected by the gate driver must be driven within one horizontal period (scanning period 1H). Thus, when the time divisional drive is executed, switching of the switches must be executed between the horizontal period 1H.

By the way, a driver for a mobile terminal has become popular as the source driver of the TFT type liquid crystal display apparatus. Here, a technique to drive 6 pixels, 9 pixels, or 12 pixels by one output of the driver is required. In such a driver, naturally, each pixel needs to be driven at the time of 1H/6, 1H/9 or 1H/12 by increasing the number of time divisions.

A case in which the 6-time-divisional drive is performed in the configuration of the TFT type liquid crystal display apparatus described in Japanese Publication (JP 2003-208132A), namely, a case of driving six pixels (two dots) will be described with reference to FIGS. 1 and 2. FIG. 2 shows timing charts in the configuration shown in FIG. 1.

The driver 101 contains six latching sections 111, six input switches SW1 to SW6 112, a D/A converter DAC 113, an amplifier 114 and a controller 120. The liquid crystal panel 140 contains six data line switches SWp1 to SWp6 144. The six latching sections 111 latch supplied display data DATAm1 to DATAm2 151, respectively. The input switches SW1 to SW6 112 are connected to the outputs of the latching sections 111, respectively. Each of the input switches SWj 112 (j=1, 2, . . . , 6) is turned on in response to an input switching control signal ENj 121.

The D/A converter 113 is connected to the input switches SW1 to SW6 112 and converts the display data DATAmj 151 from the latching section 111 connected to the input switch SWj 112 into an output gradation voltage DAOUTm 152. The amplifier 114 is connected to the D/A converter 113 and an output node OUTm. The amplifier 114 outputs the output gradation voltage DAOUTm 152 outputted from the D/A converter 113 to the output node OUTm.

Data lines SOm1 to SOm6 141 on the liquid crystal panel 140 are connected to the output node OUTm through the data line switches SWp1 to SWp6 144, respectively. A data line switch SWpj 144 among the data line switches SWp1 to SWp6 144 is turned on in response to a data line switching control signal OENj 123.

The controller 120 is connected to the input switches SW1 to SW6 112 and the data line switches SWp1 to SWp6 144. The controller 120 supplies first to sixth input switching control signals EN1 to EN6 121 to the input switches SW1 to SW6 112, respectively. Also, the controller 120 supplies first to sixth data line switching control signals OEN1 to OEN6 123 to the six data line switches SWp1 to SWp6 144 in synchronization with the input switching control signals EN1 to EN6 121, respectively.

Usually, one horizontal period (1H) is a time period obtained by dividing a time period required to rewrite data for one screen (and corresponding to a frame frequency) by the number of scans (the number of display lines). In the TFT type liquid crystal display apparatus, even if the number of time divisions is increased, the frame frequency cannot be made low in order to avoid an influence of flicker. That is, the horizontal period cannot be increased in accordance with the increase the number of time divisions. For this reason, when the number of time divisions is increased in order to decrease a chip area, for example, when an M-time division (M is a multiple of 3) is executed, the time when one source driver drives the M pixels is required to be 1H/M or less. Oppositely, unless one pixel can be driven within this time, a time longer than the horizontal period is required in the M-time division drive. Thus, the pixel on a next line cannot be driven.

Thus, as the time period during which one pixel is driven is reduced to 1H/3, 1H/6, 1H/12 . . . , the high-speed drive becomes absolutely imperative. However, in order to make the time period shorter, the settling time of the output of the D/A Converter 113 serving as the input of the amplifier 114 is required to be made shorter, and a through rate of the amplifier 114 is required to be increased and the settling time of the amplifier 114 is required to be made shorter.

In the TFT type liquid crystal display apparatus, when a 6-time-divisional drive is performed, the display data DATAm1 to DATAm6 151 are sequentially selected in synchronization with the input switching control signals EN1 to EN6 and outputted as the output gradation voltages DAOUT1 to DAOUT6 to the data lines SOm1 to SOm6 141. In the source driver 101, a time period from a time when the D/A converter 113 inputs the display data DATAmj 151 based on the input switching control signal ENj to a time when the D/A converter 113 selects and outputs the output gradation voltage DAOUTj 152 from the plurality of gradation voltages generated by the power source circuit 130 based on the display data DATAmj 151 is defined as a D/A converter delay time (Td_DA). Also, a time period from a time when the amplifier 114 inputs the output gradation voltage DAOUTj 152 to a time when the output of the amplifier 114 is stabilized (determined) is defined as an amplifier settling time (Td_Amp). In this case, a time period from the time when the display data DATAmj 151 is selected in response to the input switching control signal ENj to the time when the output gradation voltage DAOUTj 152 is outputted from the amplifier 114 is determined by a sum of the D/A converter delay time (Td_DA) and the amplifier settling time (Td_Amp).

The D/A converter delay time (Td_DA) is a delay, which is proportional to a CR time constant determined based on output impedance and parasitic load of the power source circuit 130 and a CR time constant determined based on ON resistance and parasitic capacitance of a transistor configuring the D/A converter 113. Thus, in the TFT type liquid crystal display apparatus, in order to simply reduce the D/A converter delay time (Td_DA) to ½, it is required that a total resistance (Rall) of the gradation resistors in the power source circuit 130 is reduced to ½, and the number of transistors switches in the D/A converter is doubled, so that the on resistance is reduced to ½. However, in this case, the current flowing through the gradation resistors inside the power source circuit 130 becomes double. Also, since the number of transistor switches inside the D/A converter becomes double, the layout size is also doubled. Also, in the TFT type liquid crystal display apparatus, in order to decrease the through rate and output impedance of the amplifier 114 with respect to the settling delay of the amplifier 114, it is required that a bias current is doubled and the transistor size at the output stage of the amplifier 114 is doubled.

SUMMARY OF THE INVENTION

In an aspect of the present invention, a display apparatus includes a display section; M latching sections (M is a multiple of 3 or 2) configured to receive and hold display data to be displayed on the display section, wherein the M latching sections are grouped into Y latching section groups and each of the Y latching section groups comprises X of the M latching sections (Y is an integer equal to or more than 2 and X is an integer which meets M=X×Y); M input switches respectively connected with outputs of the M latching sections, wherein the M input switches are grouped into Y switch groups, each of the Y input switch groups comprises X of the M input switches, and each of the X input switches of each of the Y input switch groups is turned on in response to an input switching control signal for Y clocks; Y digital-to-analog (D/A) converters respectively connected with the Y input switch groups, wherein each of the Y D/A converters converts the display data held by each of the X latching sections of a corresponding one of the Y latching section groups into an output gradation voltage; Y amplifiers configured to amplify and output the output gradation voltages from the Y D/A converters, respectively; Y output switches provided between outputs of the Y amplifiers and an output node, respectively, wherein each of the Y output switches is turned on in response to an output switching control signal for one clock, and M data lines connected with the output node are provided on the display section; M data line switches provided onto the M data lines, respectively, wherein each of the M data line switches is turned on in response to a data line switching control signal for one clock; and a control section configured to sequentially supply the M input switching control signals to the M input switches, sequentially supply the output switching control signal to the Y output switches, and sequentially supplies the M data line switching control signals to the M data line switches in synchronization with a $Y^{th}$ clock of the input switching control signal.

In another aspect of the present invention, a driver circuit includes M latching sections (M is a multiple of 3 or 2) configured to receive and hold display data to be displayed on a display section, wherein the M latching sections are grouped into Y latching section groups and each of the Y latching section groups comprises X of the M latching sections (Y is an integer equal to or more than 2 and X is an integer which meets M=X×Y); M input switches respectively connected with outputs of the M latching sections, wherein the M input switches are grouped into Y input switch groups, each of the Y input switch groups comprises X of the M input switches, and each of the X input switches of each of the Y input switch groups is turned on in response to an input switching control signal for Y clocks; Y digital-to-analog (D/A) converters respectively connected with the Y input switch groups, wherein each of the Y D/A converters converts the display data held by each of the X latching sections of a corresponding one of the Y latching section groups into an output gradation voltage; Y amplifiers configured to amplify and output the output gradation voltages from the Y D/A converters, respectively; Y output switches provided between outputs of the Y amplifiers and an output node, respectively, wherein each of the Y output switches, is turned on in response to an output switching control signal for one clock; wherein M data lines connected with the output node are provided on the display section, and M data line switches are interposed between the M data lines and the output node; wherein each of the M data line switches is turned on in response to a data line switching control signal for one clock; and a control section configured to sequentially supply the M input switching control signals to the M input switches, sequentially supply the output switching control signal to the Y output switches, and sequentially supplies the M data line switching control signals to the M data line switches in synchronization with a $Y^{th}$ clock of the input switching control signal.

According to the display apparatus of the present invention, the high-speed drive can be attained without any influence of the D/A converter delay time. Also, the high-speed drive can be attained without any limit of the through rate when the amplifier is driven.

BRIEF DESCRIPTION OF THE DRAWINGS

The above and other objects, advantages and features of the present invention will be more apparent from the following description of certain embodiments taken in conjunction with the accompanying drawings, in which.

DESCRIPTION OF EMBODIMENTS

Hereinafter, a TFT type liquid crystal display apparatus according to the present invention will be described in detail with reference to the attached drawings.

Figure 1:
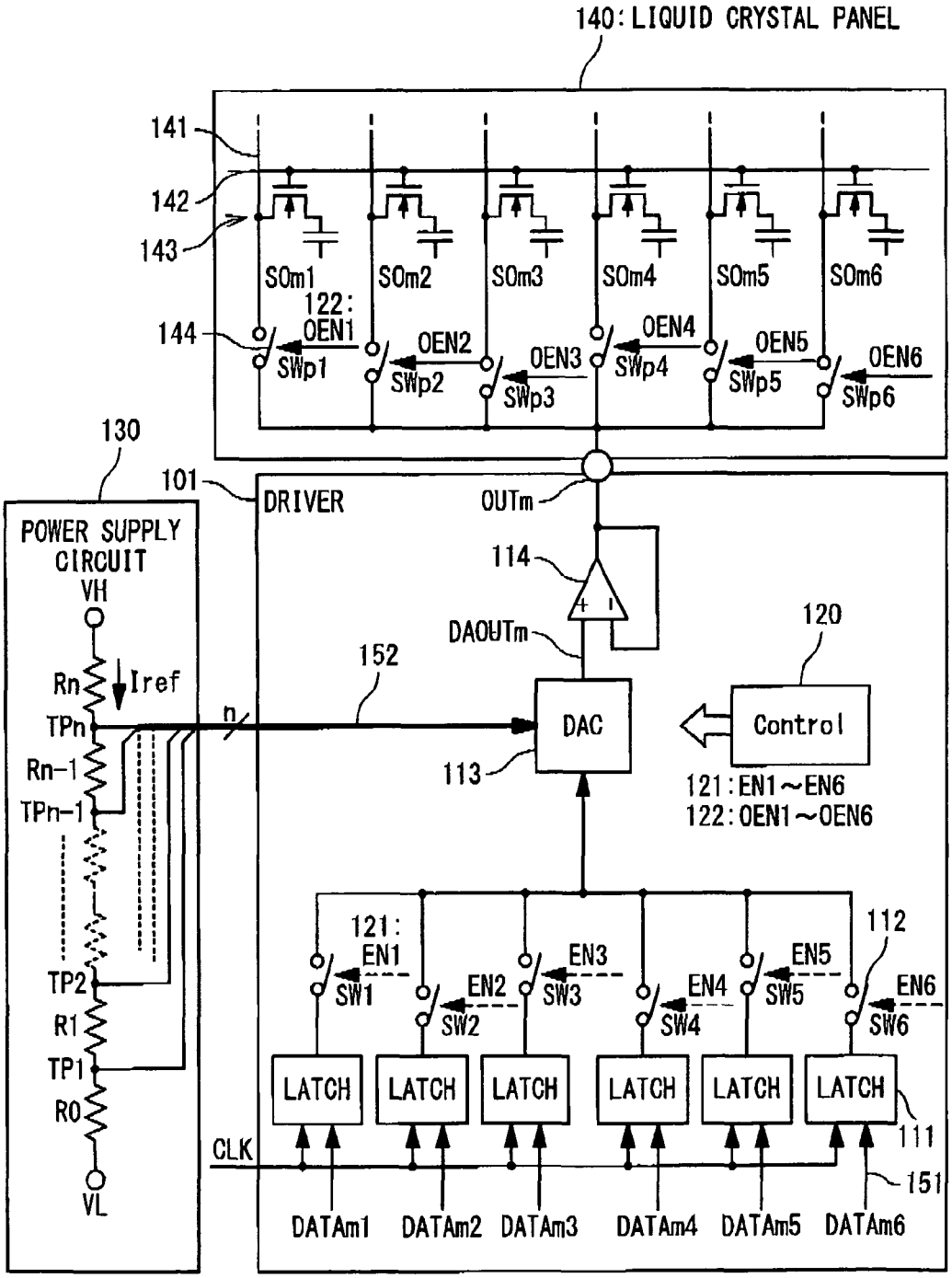
Fig. 1 RELATED ART
FIG. 1 is a block diagram showing a configuration of a conventional TFT type liquid crystal display apparatus described in which a 6-time-divisional drive is performed.
Figure 2:
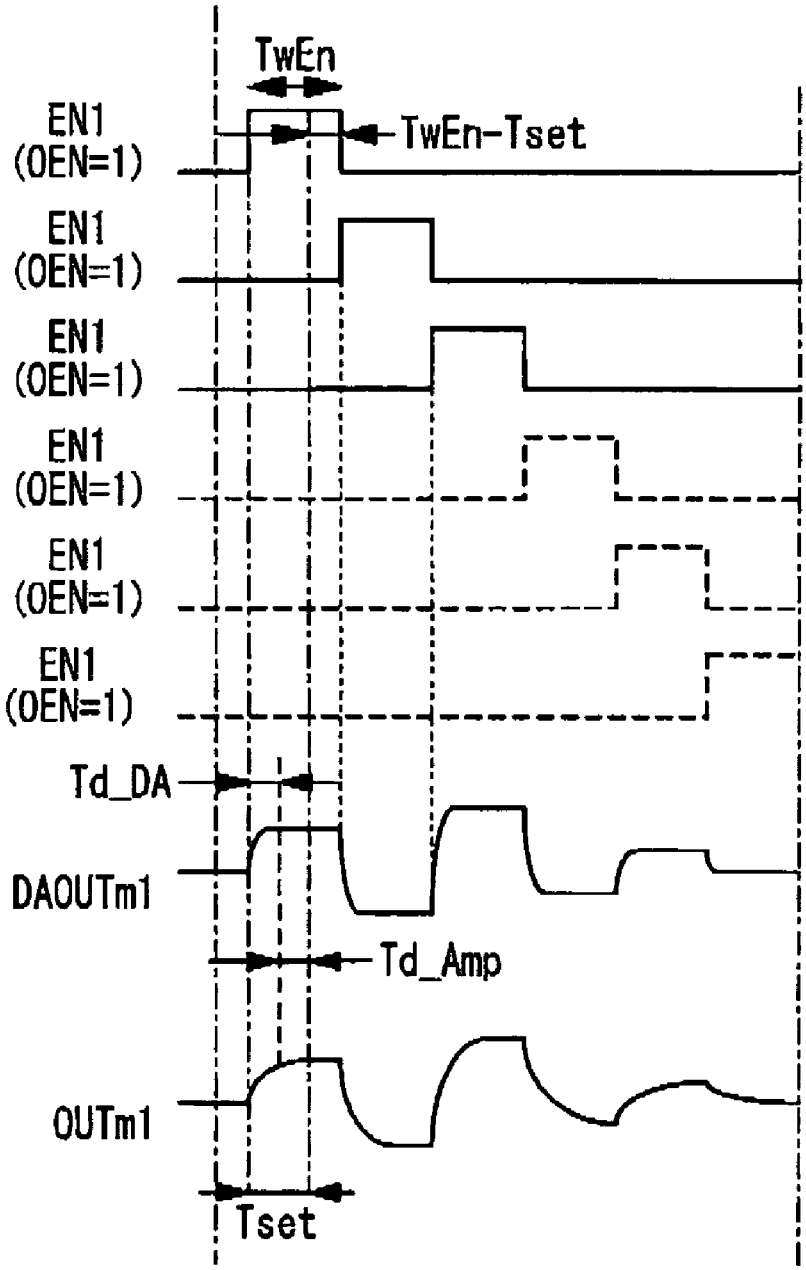
Fig. 2 RELATED ART
FIG. 2 shows timing charts on an operation of the configurations shown in FIG. 1.
Figure 3:
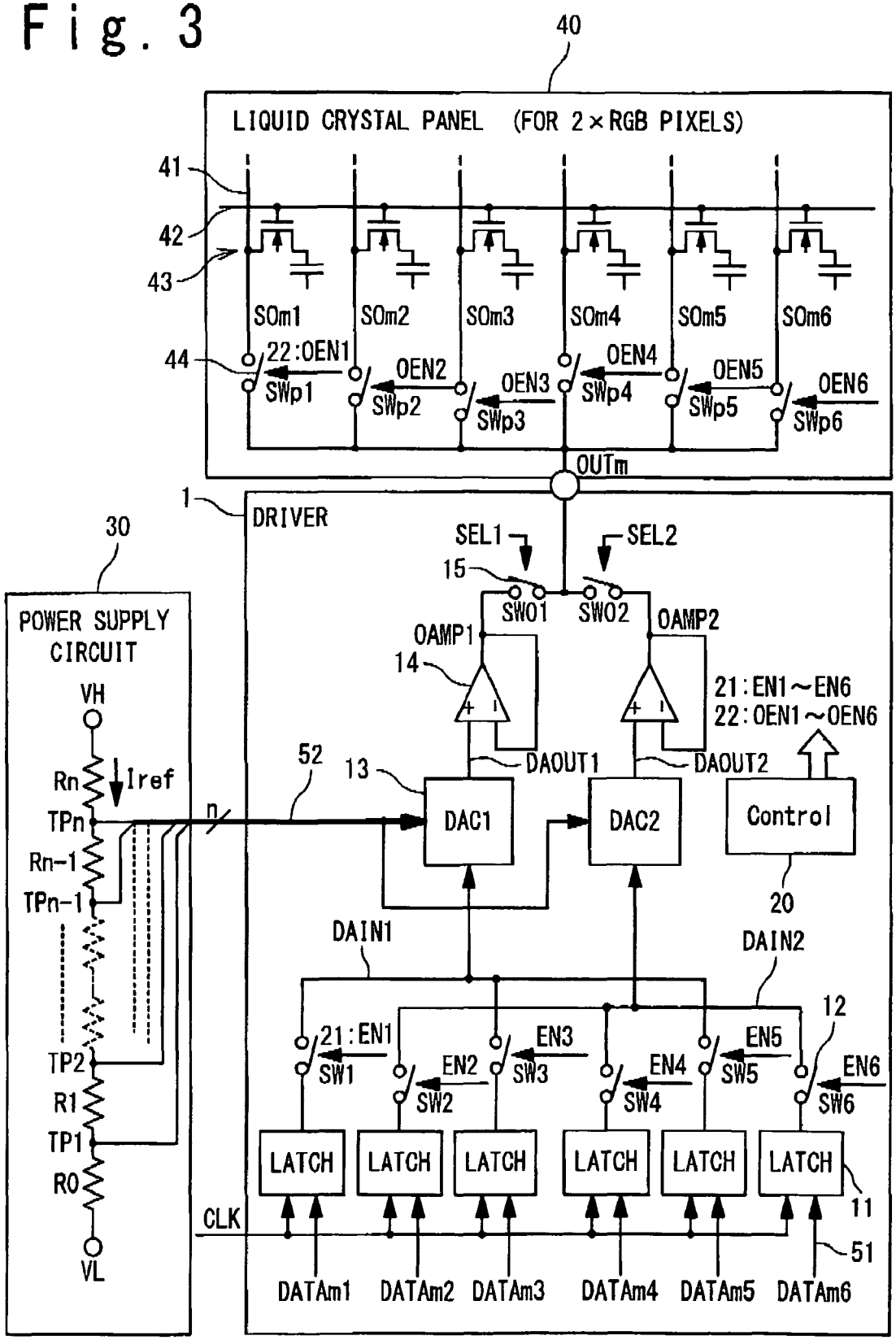
FIG. 3 is a block diagram showing a configuration of the TFT type liquid crystal display apparatus according to a first embodiment of the present invention in a case of performing a 6-time-divisional drive in which two amplifiers are used.

FIG. 3 shows a configuration of the TFT type liquid crystal display apparatus according to the present invention. The TFT type liquid crystal display apparatus contains a liquid crystal display panel 40, a gate driver (not shown), a source driver 1, and a power source circuit 30.

The liquid crystal panel 40 contains a plurality of pixels 43 that are arranged in a matrix. Each of the pixels 43 contains a thin film transistor (TFT) and a pixel capacitor. The pixel capacitor has a pixel electrode and a counter electrode opposing to the pixel electrode. The TFT has a drain electrode, a source electrode connected to the pixel electrode, and a gate electrode.

The liquid crystal panel 40 further contains a plurality of gate lines 42 and a plurality of data lines 41. Each of the plurality of gate lines 42 is connected to the gate electrodes of the TFTs of the pixels 43 on a corresponding row. Each of the plurality of data lines 41 is connected to the drain electrodes of the TFTs of the pixels 43 placed on a corresponding column.

The power source circuit 30 contains gradation resistors connected in series. In the power source circuit 30, a reference voltage is divided by the gradation resistors, to generate a plurality of gradation voltages.

In one horizontal period, a signal is supplied to the gate driver to sequentially select one of the plurality of gate lines 42 from a first gate line to a last gate line. In this case, a selection signal is outputted from the gate driver to one gate line 42. The selection signal is supplied to the gate electrodes of the TFTs of the pixels 43 on one line corresponding to the gate line 42, and the TFT is turned on based on the selection signal. The other gate lines 42 are similarly configured.

A display data for one screen (one frame) from the first line to the final line and a clock signal CLK are supplied to the source driver 1. The display data for one line includes a display data corresponding to each of the plurality of data lines 41. The source driver 1 selects one output gradation voltage from the plurality of gradation voltages based on the display data in synchronization with the clock signal CLK, and outputs to one of the plurality of data lines 41. At this time, the TFT of the pixel 43 specified by to the one gate line 42 among the plurality of gate lines 42 and the one data line of the plurality of data lines 41 is turned on. For this reason, the display data are written into the pixel capacitor of the pixels 43 and held until a next write. Consequently, the display data for the one line are displayed.

A case in which the M-time-divisional drive is performed on the TFT type liquid crystal display apparatus according to the present invention, namely, a case of driving M pixels (Y dots) will be described by using FIG. 3, in which M is a multiple of 3, Y is an integer of 2 or more, and X is an integer that satisfies $M=X\times Y$.

The driver 1 contains M latching sections 11 (first to $M^{th}$ latching sections), M input switches 12, Y D/A converters 13, Y amplifiers 14, and Y output switches 15, and a controller 20. The liquid crystal panel 40 contains M data line switches 44.

Each of the M latching sections 11 latches a supplied display data 51. The M latching sections 11 are grouped into Y groups. One group includes the X latching sections (first to $X^{th}$ latching sections) 11. The M input switches 12 are connected to the outputs of the M latching sections 11, respectively. The M input switches 12 are grouped into Y groups. One group includes the X input switches (first to $X^{th}$ input switches) 12. In the Y groups, one of the X input switches 12 is turned on in response to an input switching control signal 21.

The Y D/A converters 13 are connected to the Y groups of switches 12, respectively. Each of the Y D/A converters 13 converts the display data 51 of the latching section 11 connected to one of the input switches 12 of a corresponding group, into an output gradation voltage 52. The inputs of the Y amplifiers 14 are connected to the outputs, of the Y D/A converters 13, respectively. The Y amplifiers 14 output the output gradation voltages 52 from the Y D/A converters 13, respectively.

The Y output switches 15 are provided between the outputs of the Y amplifiers 14 and an output node OUTm, respectively. One output switch 15 of the Y output switches 15 is turned on in response to an output switching control signal 22.

The M data lines 41 connected to the output node OUTm are provided in the liquid crystal panel 40. M data line switches 44 are provided for the M data lines 41, respectively. One data line switch 44 of the M data line switches 44 is turned on in response to a data line switching control signal 23.

The controller 20 is connected to the M input switches 12, the Y output switches 15 and the M data line switches 44. The controller 20 sequentially supplies first to $M^{th}$ input switching control signals 21 to the respective M input switches 12. The controller 20 sequentially supplies the first to $Y^{th}$ output switching control signals 22 to the respective Y output switches 15. The controller 20 sequentially supplies the first to $M^{th}$ data line switching control signals 23 to the respectively M data line switches 44 in synchronization with the $Y^{th}$ clock of the input switching control signal 21.

In the TFT type liquid crystal display apparatus according to the present invention, one output is provided with the Y D/A converters 13, the Y amplifiers 14 and the Y output switches 15. The M latching sections 11 are grouped into the Y groups as well as the M input switches 12. Thus, the output switch 15 selects one among the outputs of the amplifiers 14 in synchronization with one output switching control signal 22 (at a time-divisional timing). Also, when a switching period between the output switches 15 is assumed to be T, the time period during which the D/A converter 13 inputs the display data 51 is set to be a time period (Y×T) by advancing a phase by T/Y from the time-divisional timing. That is, when the D/A converter 13 inputs the display data 51 during the input switching control signal 21 for Y clocks, the output gradation voltage 52 based on the display data 51 is outputted from the amplifier 14 at the $Y^{th}$ clock of the input switching control signal 21. Consequently, in the TFT type liquid crystal display apparatus according to the present invention, the high-speed drive can be attained without any influence of the DA converter delay time (Td_DA). Also, the high-speed drive can be attained without any limit of a through-rate when the amplifier 14 is driven.

The TFT type liquid crystal display apparatus according to the present invention will be described below by using a specific example.

First Embodiment

Figure 4:
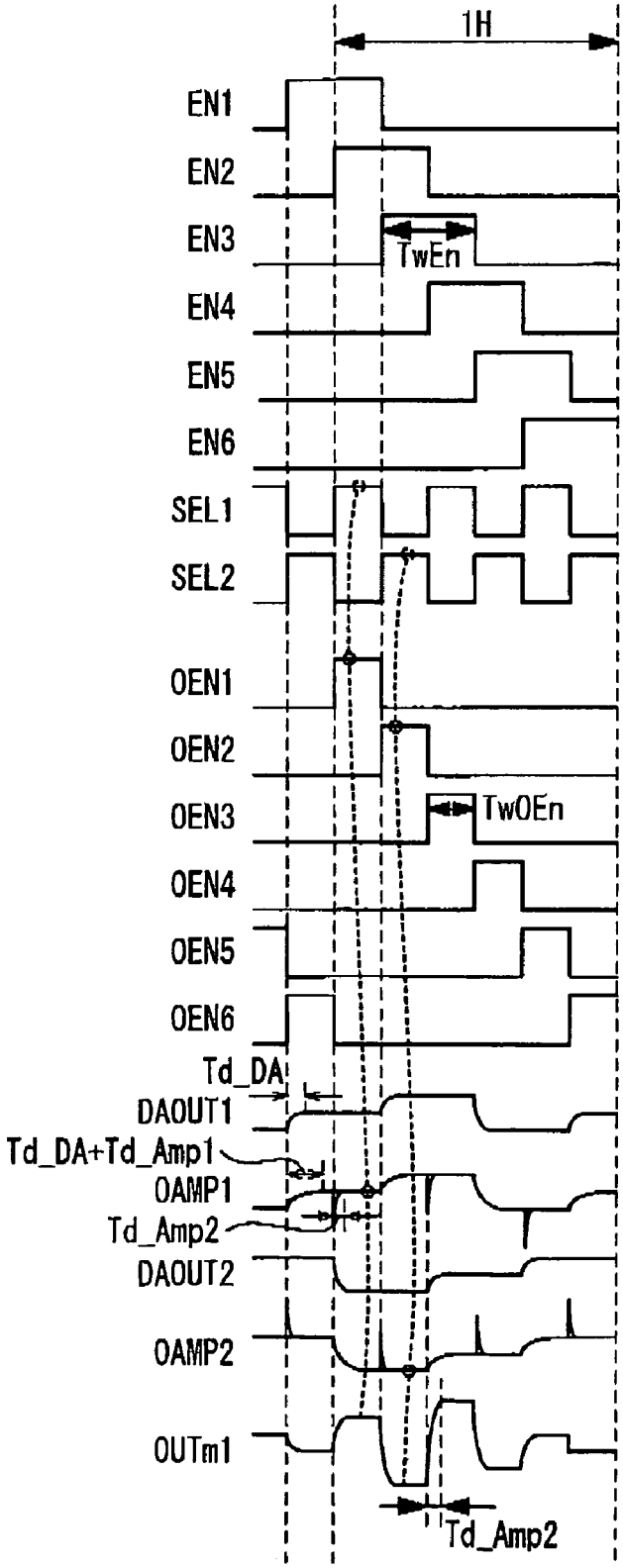
FIG. 4 shows timing charts in an operation of the configuration shown in FIG. 3.

FIG. 3 shows the configuration of the TFT type liquid crystal display apparatus according to a first embodiment of the present invention in a case of executing the 6-time-divisional drive in which the two amplifiers are used (six pixels (two dots)). FIG. 4 shows timing charts of operations of the apparatus shown in FIG. 3.

In the TFT type liquid crystal display apparatus according to the first embodiment of the present invention, the liquid crystal panel 40 is applied to the color display of RGB that indicates the primary colors of red, green and blue. When M is a multiple of 3, X indicates 3, and Y indicates 2 or more. In this embodiment, for example, an example that M, X and Y are 6, 3 and 2, respectively, will be described.

The driver 1 contains the first to sixth latching sections 11, the six input switches SW1 to SW6 12, the two input D/A converters DAC1 to DAC2 13, the two amplifiers OAMP1 to OAMP2 14, the two output switches SWO1 to SWO2 15, and the controller 20. The liquid crystal panel 40 contains the six data line switches SWp1 to SWp6 44. The six latching sections 11 hold the display data DATAm1 to DATAm6 51 supplied thereto, respectively. The six latching sections 11 are grouped into two groups. The first group includes the first, third and fifth latching sections 11 that are the odd-numbered latching sections 11. The second group includes the second, fourth and sixth latching sections 11 that are the even-numbered latching sections 11.

The six input switches SW1 to SW6 12 are connected to the outputs of the six latching sections 11, respectively. The six input switches SW1 to SW6 12 are grouped into two groups. The first group includes the first, third and fifth input switches SW1, SW3 and SW5 12, which are the odd-numbered input switches 12. As one of the input switches SW1, SW3 and SW5 12, the input switch SWI 12 (I=1, 3, 5) is turned on in response to the input switching control signal 21 for two clocks. The second group includes the second, fourth and sixth input switches SW2, SW4 and SW6 12, which are the even-numbered input switches 12. As one of the input switches SW2, SW4 and SW6 12, the input switch SWJ 12 (J=2, 4, 6) is turned on in response to the input switching control signal 21 for two clocks. Here, a period for two clocks is defined as one selection period (TwEn).

The two D/A converters DAC1 to DAC2 13 are connected to the two groups of switches 12, respectively. That is, the D/A converter DAC1 13 as a first D/A converter 13 is connected to the three input, switches SW1, SW3, and SW5 12 of the first group. The D/A converter DAC2 13 as a second D/A converter 13 is connected to the three input switches SW2, SW4, and SW6 of the second group. The D/A converter DAC1 13 converts the display data DATAmI 51 of the latching section 11, which is connected to the input switch SWI 12 (I=1, 3, 5) of the first group, into the output gradation voltage DAOUT1 52. The D/A converter DAC2 13 converts the display data DATAmJ 51 of the latching section 11, which is connected to the one input switch SWJ 12 (J=2, 4, 6) of the second group, into the output gradation voltage DAOUT2 52.

The input of the amplifier OAMP1 14 as a first amplifier 14 of the two amplifiers OAMP1 to OAMP2 14 is connected to the output of the D/A converter DAC1 13. The input of the amplifier OAMP2 14 as a second amplifier 14 is connected to the output of the D/A converter DAC2 13. The amplifier OAMP1 14 outputs the output gradation voltage 52 DAOUT1 from the D/A converter DAC1 13, and the amplifier OAMP2 14 outputs the output gradation voltage DAOUT2 52 from the D/A converter DAC2 13.

The output switch SWO1 15 as a first output switch 15 of the two output switches SWO1 to SWO2 15 is provided between the output of the amplifier OAMP1 14 and the output node OUTm. The output switch SWO2 15 as the second output switch 15 is provided between the output of the amplifier OAMP2 14 and the output node OUTm. The output switch SWOK 15 (K=1, 2) as one output switch 15 of the two output switches SWO1 to SWO2 15 is turned on in response to the output switching control signal SELK 22 (K=1, 2) for one clock.

The six data lines SOm1 to SOm6 41 connected to the output node OUTm are provided on the liquid crystal panel 40. The six data line switches SWp1 to SWp6 44 are provided on the six data lines SOm1 to SOm6 41, respectively. One SWpj (j=1, 2, . . . , 6) of the six data line switches SWp1 to SWp6 44 is turned on in response to a data line switching control signal OENj 23 for one clock. Here, a period for one clock is defined as one selection period (TwOEn).

The controller 20 is connected to the six input switches SW1 to SW6 12, the two output switches SWO1 to SWO2 15, and the six data line switches SWp1 to SWp6 44. The controller 20 sequentially supplies first to sixth input switching control signals EN1 to EN6 21 to the six input switches SW1 to SW6 12. The controller 20 sequentially supplies first and second output switching control signals SEL1 to SEL2 22 to the two output switches SWO1 to SWO2 15. The controller 20 sequentially supplies first to sixth data line switching control signals OEN1 to OEN6 23 to the six data line switches SWp1 to SWp6 44 in synchronization with the second clock of the input switching control signals EN1 to EN6 21.

As shown in FIG. 4, each of the selection periods (TwEn) of the input switching control signals EN1 to EN6 21 is equal to two times (2×TwOEn) of each of the data line switching control signals OEN1 to OEN6 23. Each of the phases of the input switching control signals EN1 to EN6 21 advances by one selection period of each of the data line switching control signals OEN1 to OEN6 23.

Figure 5:
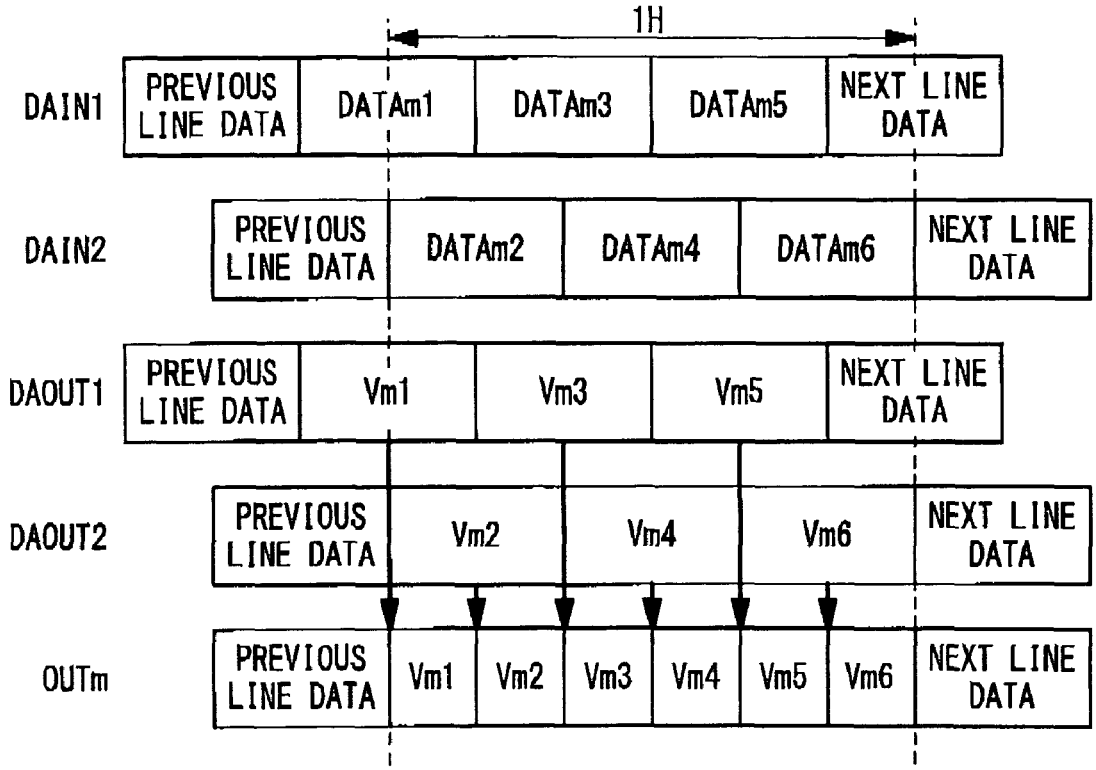
FIG. 5 is a diagram showing a progress of the operation of the TFT type liquid crystal display apparatus according to a first embodiment of the present invention.

FIG. 5 is a diagram showing a progress of the operation of the TFT type liquid crystal display apparatus according to the first embodiment of the present invention. FIG. 5 shows the data states at various points, when the input and output of the first D/A converter (DAC1) 13 are defined as DAIN1 and DAOUT1, respectively, and the input and output of the second D/A converter (DAC2) 13 are defined as DAIN2 and DAOUT2, respectively, and the output value of the final output terminal is defined as OUTm. According to FIG. 5, when the change points of the inputs/outputs of the first and second D/A converters 13 are exactly shifted by the period of T/2 and the first and second D/A converters 13 input the display data 51 between 0 and T/2, the display data 51 (i.e. output gradation voltages 52) between T/2 and T are reflected on the output.

Here, in this embodiment, the change period of the D/A converter input is a half of the D/A converter input period (TwOEn). However, if the D/A converter itself has sufficient drive ability, there is no problem even in a case of a quarter of the D/A converter input period. In order to avoid influence on the amplifier drive period, the phase of the period may be shifted in the range of TwOEn to Td_DAC.

According to the TFT type liquid crystal display apparatus according to the first embodiment of the present invention, the two D/A converters 13, the two amplifiers 14 and the two output switches 15 are provided for one output. The six latching sections 11 and the six input switches 12 are grouped into the two groups. The output switches 15 switch the outputs of the amplifiers 14 in synchronization with the time-divisional period of the output switching control signal 22. Also, when the switching period of the output switch 15 is assumed to be T, a period during which the D/A converter 13 inputs the display data 51 is assumed to be the period of (2×T), by advancing the phase by T/2 from the time-divisional period. That is, when the D/A converter 13 inputs the display data 51 in response to the input switching control signal 21 for the two clocks, the output gradation voltage 52 based on the display data 51 is outputted from the amplifier 14 at the time of the second clock of the input switching control signal 21. Consequently, according to the TFT type liquid crystal display apparatus according to the first embodiment of the present invention, the high speed drive can be attained without any influence of the D/A converter delay time (Td_DA). Also, the high speed drive can be attained without any limit of the through-rate when the amplifier 14 is driven.

Second Embodiment

In the liquid crystal panel 40, one dot is configured such that the pixels of R, G and B are arranged. However, except for a special display for a panel test such as a stripe display of white and black that is not typical, the brightnesses of the pixels of R, G and B adjacent to each other are substantially equal to each other in many cases. Now, supposing that the dots adjacent to each other are assumed to be [R1, G1, B1] and [R2, G2, B2], [R1] and [R2] have brightnesses equal to each other as well as [G1] and [G2], and [B1] and [B2]. This can be understood from the following consideration. [R1] and [G1] are arranged closer than [R1] and [R2]. However, for example, when a reddish natural image is displayed in a case of being not the stripe display, [R1]>>[G1], [B1] and [R2]>>[G2], [B2] are established. Thus, evidently, [R1]>>[G1] is established. However, [R1]>>[R2] is not established. Thus, as the display data 51 (i.e. output gradation voltage 52), the voltage between the pixels whose colors are different is changed larger than the voltage between the same pixels that are adjacent to each other. Thus, when a driver (D/A converter+amplifier) driving [R1] drives [R2], a change in voltage is smaller. For this reason, a useless charging/discharging caused by the amplifier, and a useless charging/discharging from/to parasitic capacitance when the D/A converter and the switch inside the source driver 1 are switched are small. Therefore, this is advantageous in view of the consumption current and even from the viewpoint of a settling time of the amplifier. In order to attain this, in the second embodiment, the three drivers (D/A converters and amplifiers) are contained (to be referred to as DRIVERs in FIG. 6 which will be described later), and the data inputs to the drivers are related for each of R, G and B. Therefore, the three amplifiers drive R, G and B, respectively, and a useless circuit and a charging/discharging from/to the panel can be reduced.

Figure 6:
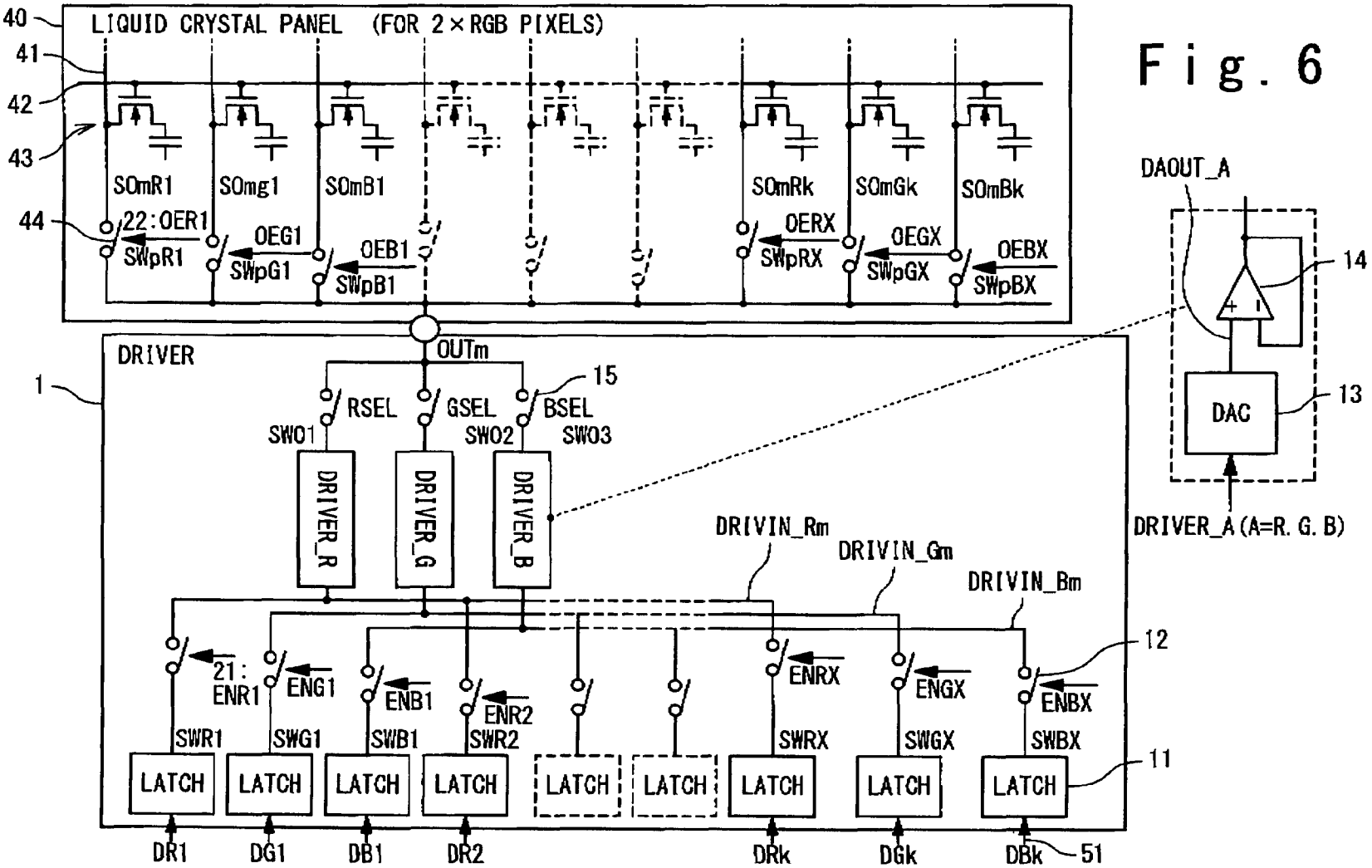
FIG. 6 is a block diagram showing the configuration of the TFT type liquid crystal display apparatus according to a second embodiment of the present invention in a case of performing a 3X-time-divisional drive in which three amplifiers are used.
Figure 7:
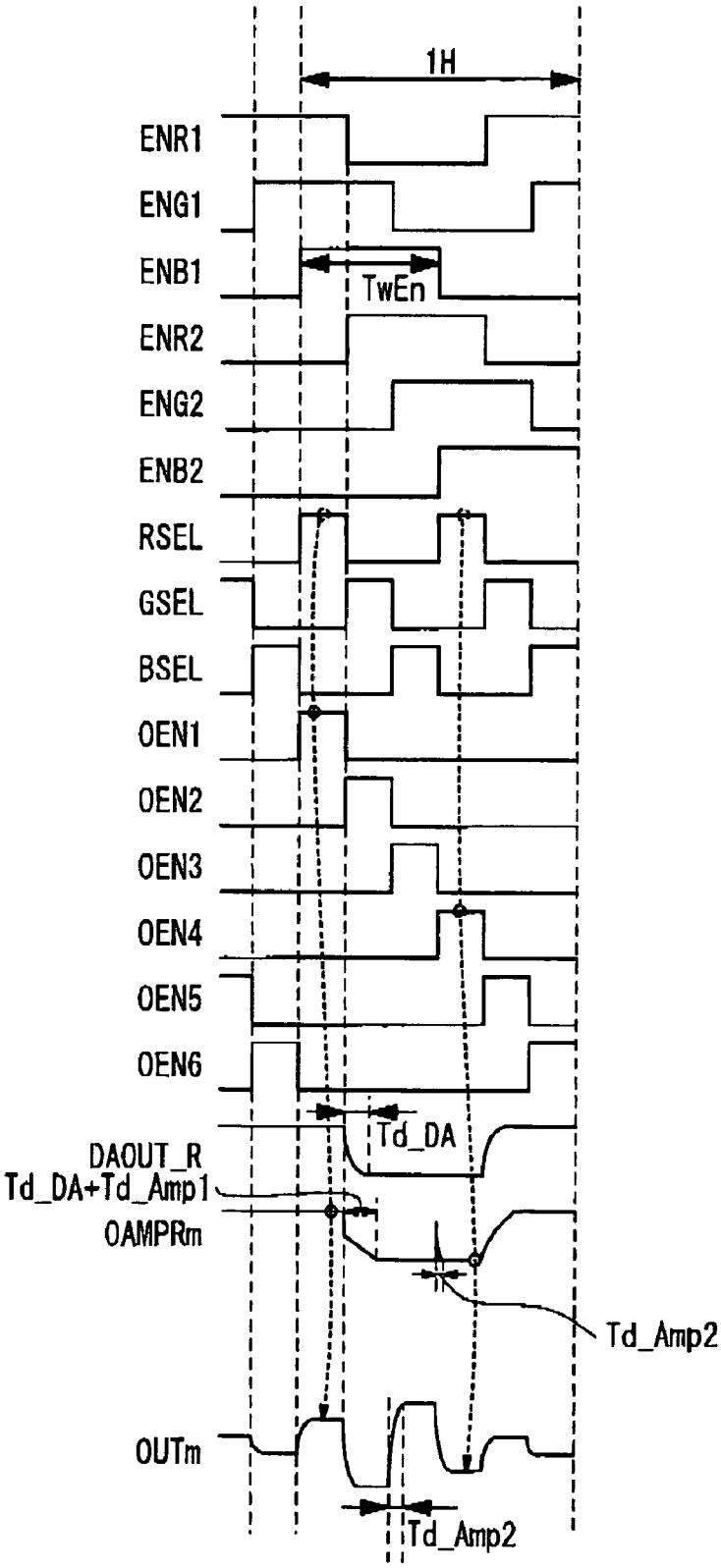
FIG. 7 shows timing charts in an operation of the configuration shown in FIG. 6.

FIG. 6 shows a configuration of the TFT type liquid crystal, display apparatus according to the second embodiment of the present invention in which a 3X-time-divisional drive using three amplifiers is performed. FIG. 7 shows timing charts of the operations in the configuration shown in FIG. 6.

In the TFT type liquid crystal display apparatus according to the second embodiment of the present invention, the liquid crystal panel 40 is applied to a color display of RGB indicating the primary colors of red, green and blue. When M is a multiple of 3, Y indicates 3, and X indicates 2 or more. In this case, the driver 1 contains the first to $M^{th}$ latching sections 11, the M input switches SWR1, SWG1, SWB1, . . . , SWRX, SWGX, and SWBX 12, the three D/A converters 13, the three amplifiers 14, the three output switches SWO1 to SWO3 15, and the controller 20. The liquid crystal panel 40 contains the M data line switches SWpR1, SWpG1, SWpB1, . . . , SWpRX, SWpGX, and SWpBX 44. The M latching sections 11 hold the display data DR1, DG1, DB1, . . . , DRX, DGX, and DBX 51 supplied thereto, respectively. The M latching sections 11 are grouped into three groups. The first group among the three groups includes X latching sections 11, as the latching sections 11 applied to the red color. The second group thereof includes X latching sections 11, as the latching sections 11 applied to the green color. The third group thereof includes X latching sections 11, as the latching sections 11 applied to the green color.

The M input switches SWR1, SWG1, SWB1, . . . , SWRX, SWGX, and SWBX 12 are connected to the outputs of the M latching sections 11, respectively. The M input switches SWR1, SWG1, SWB1, . . . , SWRX, SWGX, and SWBX 12 are grouped into three groups. The first group of the three groups includes X input switches SWR1, . . . , and SWRX 12, as the input switches 12 applied to the red color. One input switch SWRZ 12 (Z=1, 2, . . . , X) among the X input switches SWR1, . . . , and SWRX 12 is turned on in response to the input switching control signal 21 for three clocks. The second group thereof includes X input switches SWG1, . . . , and SWGX 12, as the input switches 12 applied to the green color. One input switch SWGZ 12 (Z=1, 2, . . . , X) of the X input switches SWG1, . . . , and SWGX 12 is turned on in response to the input switching control signal 21 for three clocks. The third group thereof includes X input switches SWB1, . . . , and SWBX 12, as the input switches 12 applied to the blue color. One input switch SWBZ 12 (Z=1, 2, . . . , X) of the X input switches SWB1, . . . , and SWBX 12 is turned on in response to the input switching control signal 21 for three clocks. Here, a period for three clocks is defined as one selection period (TwEn).

The three D/A converters 13 are connected to the three groups, respectively. That is, of the three D/A converters 13, the first D/A converter 13 applied to the red color is connected to the X input switches SWR1, . . . , and SWRX 12 of the first group. The second D/A converter 13 applied to the green color is connected to the X input switches SWG1, . . . , and SWGX 12 of the second group. The third D/A converter 13 applied to the blue color is connected to the X input switches SWB1, . . . , and SWBX 12 of the third group. The first D/A converter 13 converts the display data DRZ 51 from the latching section 11, which is connected to the one input switch SWRZ 12 (Z=1, 2, . . . , X) of the first group, into the output gradation voltage DAOUT_R 52. The second D/A converter 13 converts the display data DGZ 51 from the latching section 11, which is connected to the one input switch SWGZ 12 (Z=1, 2, . . . , X) of the second group, into the output gradation voltage DAOUT_G 52. The third D/A converter 13 converts the display data DBZ 51 from the latching section 11, which is connected to the one input switch SWBZ 12 (Z=1, 2, . . . , X) of the third group, into the output gradation voltage DAOUT_B 52.

The input of the first amplifier 14 among the three amplifiers 14 is connected to the output of the first D/A converter 13. The input of the second amplifier 14 is connected to the output of the second D/A converter 13. The input of the third amplifier 14 is connected to the output of the third D/A converter 13. The first amplifier 14 outputs the output gradation voltage DAOUT_R 52 from the first D/A converter 13. The second amplifier 14 outputs the output gradation voltage DAOUT_G 52 from the second D/A converter 13. The third amplifier 14 outputs the output gradation voltage DAOUT_B 52 from the third D/A converter 13.

Of the three output switches SWO1 to SWO3 15, the output switch SWO1 15 as the first output switch 15 is provided between the output of the first amplifier 14 and the output node OUTm. The output switch SWO2 15 as the second output switch 15 is provided between the output of the second amplifier 14 and the output node OUTm. The output switch SWO3 15 as the third output switch 15 is provided between the output of the third amplifier 14 and the output node OUTm. The output switch SWOK 15 (K=1, 2, 3) as one output switch 15 among the three output switches SWO1 to SWO3 15 is turned on in response to the output switching control signal 22 (ASEL 22 (A=R, G, B) for one clock. The M data lines SOmR1, SOmG1, SOmB1, . . . , SOmRX, SOmGX, and SOmBX 41 connected to the output node OUTm are provided on the liquid crystal panel 40.

The M data line switches SWpR1, SWpG1, SWpB1, . . . , SWpRX, SWpGX, and SWpBX 44 are provided on the M data lines SOmR1, SOmG1, SOmB1, . . . , SOmRX, SOmGX, and SOmBX 41, respectively. One data line switch 44 among the M data line switches SWpR1, SWpG1, SWpB1, . . . , SWpRX, SWpGX, and SWpBX 44 is turned on in response to the data line switching control signal 23 for one clock. Here, a period for one clock is defined as one selection period (TwOEn).

The controller 20 is connected to the M input switches SWR1, SWG1, SWB1, . . . , SWRX, SWGX, and SWBX 12, the three output switches SWO1 to SWO3 15, and the M data line switches SWpR1, SWpG1, SWpB1, . . . , SWpRX, SWpGX, and SWpBX 44. The controller 20 sequentially supplies the first to $M^{th}$ input switching control signals ENR1, ENG1, ENB1, . . . , ENRX, ENGX, and ENBX 21 to the M input switches SWR1, SWG1, SWB1, . . . , SWRX, SWGX, and SWBX 12, respectively. The controller 20 sequentially supplies the first to third output switching control signals RSEL, GSEL, and BSEL 22 to the three output switches SWO1 to SWO3 15, respectively. The controller 20 sequentially supplies the first to $M^{th}$ data line switching control signals OER1, OEG1, OEB1, . . . , OERX, OEGX, and OEBX 23 to the M data line switches SWpR1, SWpG1, SWpB1, . . . , SWpRX, SWpGX, and SWpBX 44, respectively, in synchronization with the third clock of the input switching control signal 21.

As shown in FIG. 7, each of the selection periods (TwEn) of the input switching control signals ENR1, ENG1, ENB1, . . . , ENRX, ENGX, and ENBX 21 is equal to three times (3×TwOEn) the period of a corresponding one of the data line switching control signals OER1, OEG1, OEB1, . . . , OERX, OEGX, and OEBX 23. Each of the phases of the input switching control signals ENR1, ENG1, ENB1, . . . , ENRX, ENGX, and ENBX 21 advances by two selection periods than a phase of a corresponding one of the data line switching control signals OER1, OEG1, OEB1, . . . , OERX, OEGX, and OEBX 23.

Figure 8:
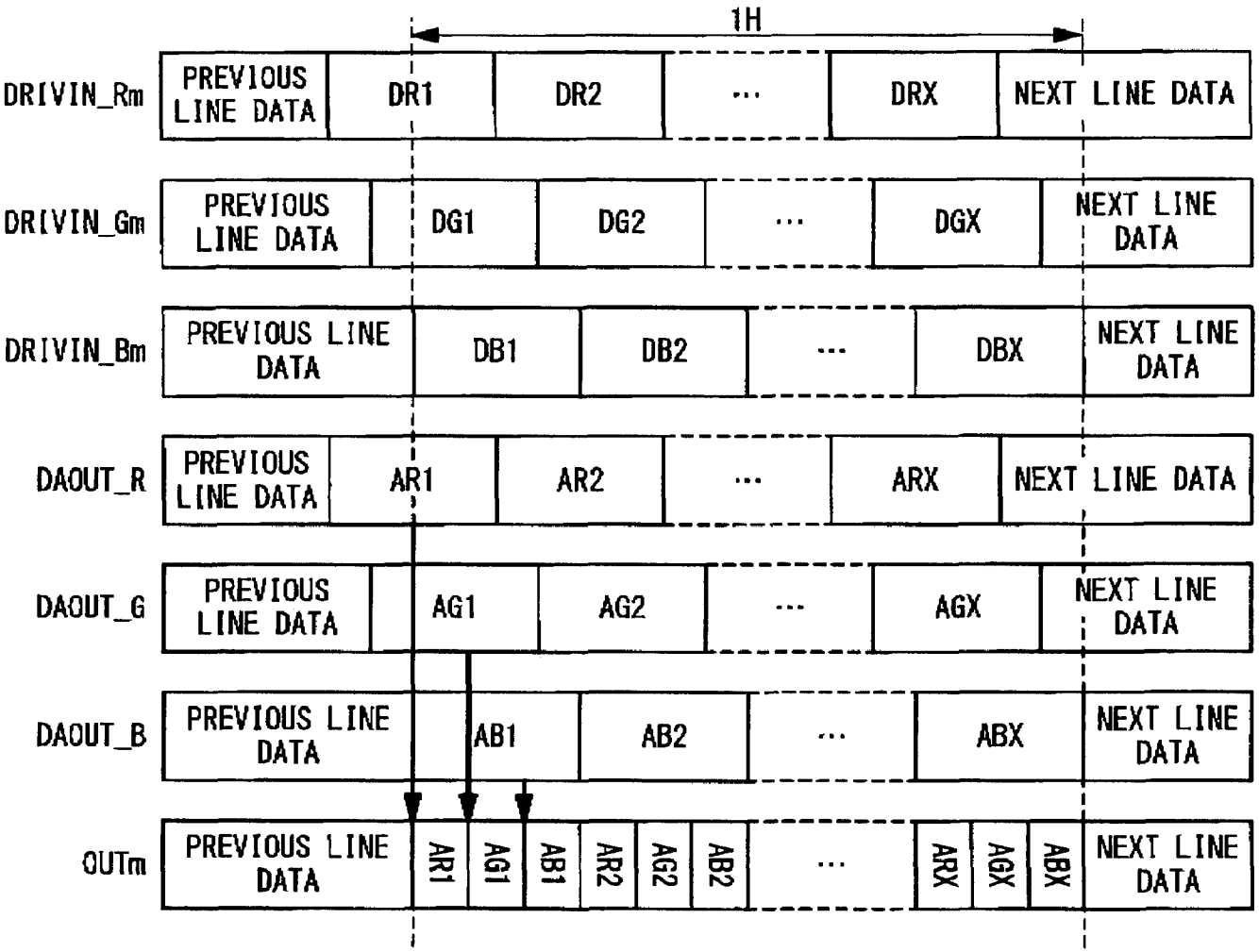
FIG. 8 is a diagram showing a progress of an operation of the TFT type liquid crystal display apparatus according to the second embodiment of the present invention.

FIG. 8 is a diagram showing a progress of the operation of the TFT type liquid crystal display apparatus according to the second embodiment of the present invention. The data states at respective points are shown, when the input and output of the first D/A converter 13 are defined as DRIVIN_Rm and DAOUT_R, respectively, and the input and output of the second D/A converter 13 are defined as DRIVIN_Gm and DAOUT_G, respectively, and the input and output of the third D/A converter 13 are defined as DRIVIN_Bm and DAOUT_B, respectively, and the output value of the final output terminal is defined as OUTm. According to FIG. 8, when the change points of the inputs/outputs of the first to third D/A converters 13 are shifted exactly by the period of T/3 and the first and second D/A converters 13 input the display data 51 between 0 and T/3, the display data 51 (i.e. output gradation voltages 52) between 2T/3 and T are reflected on the output.

According to the TFT type liquid crystal display apparatus according to the second embodiment of the present invention, the three D/A converters 13, the three amplifiers 14 and the three output switches 15 are provided for one output. The M (M=3X) latching sections 11 and the (3X) input switches 12 are grouped into the three groups. The output switches 15 switch the outputs of the amplifiers 14 in synchronization with the time-divisional period (of the output switching control signal 22). Also, when the switching period of the output switch 15 is, assumed to be T, the period during which the D/A converter 13 inputs the display data 51 is assumed to be the period of (3×T), by advancing the phase by T/3 from the time-divisional period. That is, when the D/A converter 13 inputs the display data 51 in response to the input switching control signal 21 for three clocks, the output gradation voltage 52 based on the display data 51 is outputted from the amplifier 14 at the third clock of the input switching control signal 21. Consequently, according to the TFT type liquid crystal display apparatus according to the second embodiment of the present invention, the high-speed drive can be attained without any influence of the D/A converter delay time (Td_DA). Also, the fast drive can be attained without any limit of the through rate when the amplifier 14 is driven.

According to the TFT type liquid crystal display apparatus according to the second embodiment of the present invention, the data inputs to the three drivers (the D/A converters 13 and the amplifiers 14) are related for each of R, G and B. Thus, the three amplifiers 14 drive R, G and B, respectively, and a useless circuit and charging/discharging from/to the panel are reduced.

Third Embodiment

In the dot inversion drive, the polarities of the outputs of the pixels adjacent to each other are different. Thus, two amplifiers of a positive amplifier and a negative amplifier are assigned to the two outputs, and the outputs are alternately switched by switches in accordance with the positive and negative polarities (for example, Japanese Laid Open Patent Application (JP-P 2007-163913A). Even in the dot inversion drive, the present invention can be applied when the time-divisional drive is carried out. In order to attain this, in the third embodiment, a driver circuit (to be referred to as DRIVERs in FIG. 9 which will be described later) requires two elements×two polarities (the positive and negative polarities) at least.

Figure 9:
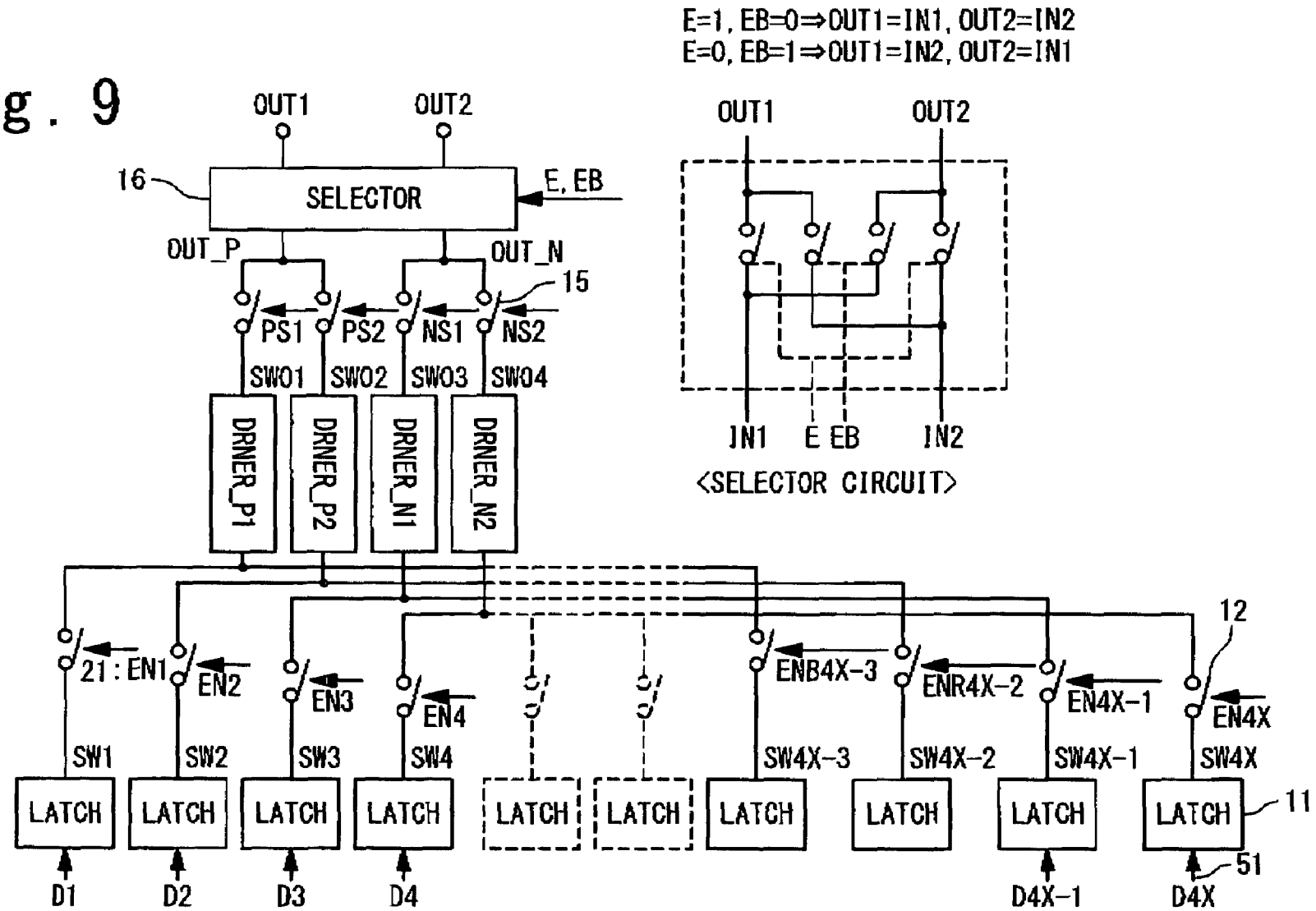
FIG. 9 is a block diagram showing the configuration of the TFT type liquid crystal display apparatus according to a third embodiment of the present invention in a case of performing a dot inversion drive in which four amplifiers are used.
Figure 10:
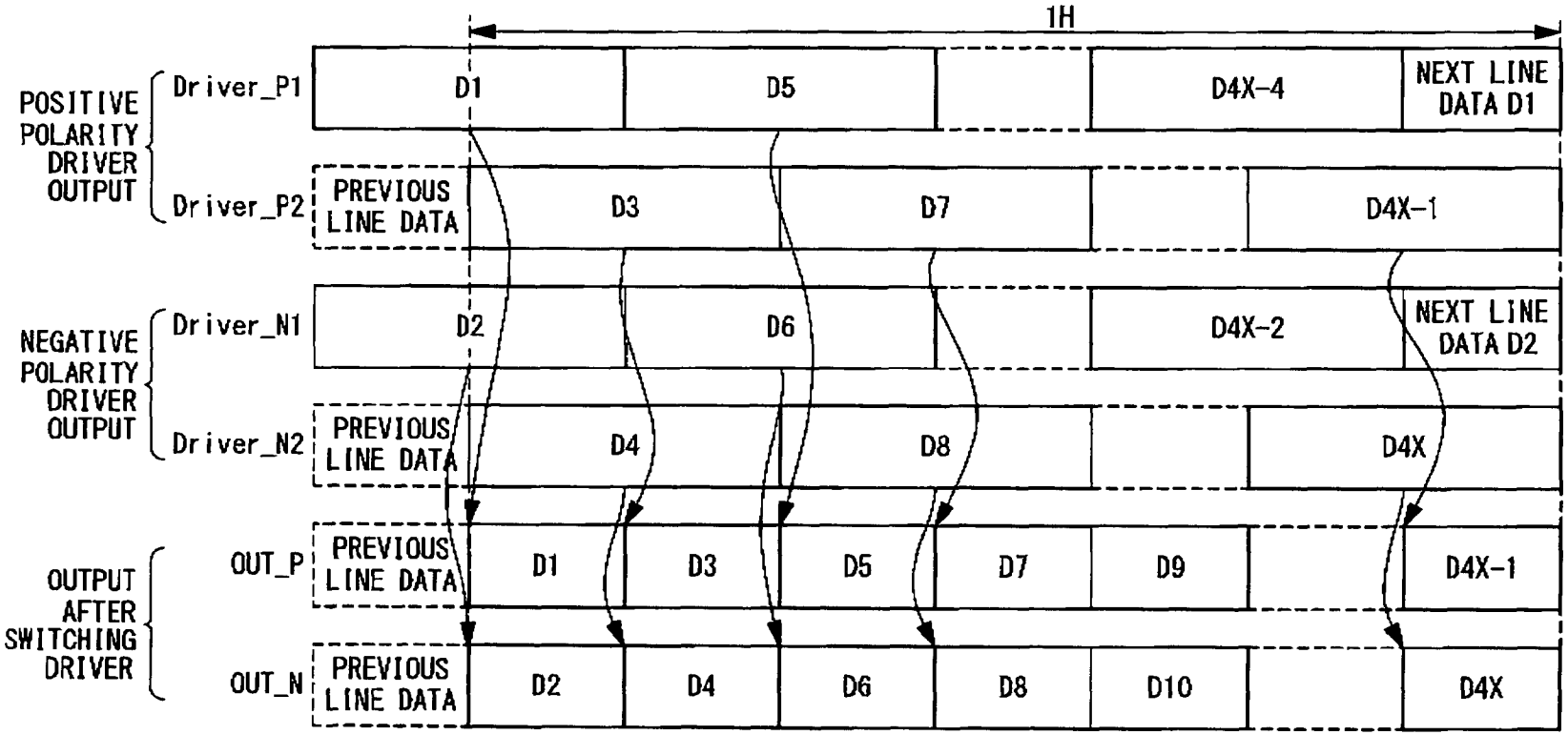
FIG. 10 is a diagram showing the operation of the configuration shown in FIG. 9.

FIG. 9 shows a configuration of the TFT type liquid crystal display apparatus according to the third embodiment of the present invention in a case of performing the dot inversion, drive in which four amplifiers are used. FIG. 10 is a diagram showing the operation of the configuration shown in FIG. 9.

In the TFT type liquid crystal display apparatus according to the third embodiment of the present invention, the liquid crystal panel 40 is applied to the positive drive and the negative drive in the 2-dot inversion drive. When M is a multiple of 2, Y indicates 4, and X indicates 2 or more.

In this case, the driver 1 contains the first to $M^{th}$ latching sections 11, the M input switches SW1, SW2, SW3, SW4, . . . , SW4X-3, SW4X-2, SW4X-1, and SW4X 12, the four D/A converters 13, the four amplifiers 14, the four output switches SWO1 to SWO4 15, the M data line switches 44, the controller 20 and a selector circuit 16. The liquid crystal panel 40 contains the M data, line switches 44. The M latching sections 11 hold the display data D1, D2, D3, D4, . . . , D4X-3, D4X-2, D4X-1, and D4X 51 supplied thereto, respectively. The M latching sections 11 are grouped into four groups. The first group among the four groups includes X latching sections 11 which are the first, fifth, . . . , $(4X\text{-}3)^{th}$ latching sections 11 among the M latching sections 11. The second group includes X latching sections 11 which are the second, sixth, . . . , $(4X\text{-}2)^{th}$ latching sections 11. The third group includes X latching sections 11 which are the third, seventh, . . . , $(4X\text{-}1)^{th}$ latching sections 11. The fourth group among the four groups includes the X latching sections 11 which are the fourth, eighth, . . . , $4X^{th}$ latching sections 11.

The M input switches SW1, SW2, SW3, SW4, . . . , SW4X-3, SW4X-2, SW4X-1, and SW4X 12 are connected to the outputs of the M latching sections 11, respectively. The M input switches SW1, SW2, SW3, SW4, . . . , SW4X-3, SW4X-2, SW4X-1, and SW4X 12 are grouped into four groups. The first group among the four groups includes the first, fifth, . . . , and $(4X\text{-}3)^{th}$ input switches SW1, SW5, . . . , and SW(4X-3) 12. One input switch 12 among the input switches SW1, SW5, . . . , and SW(4X-3) 12 is turned on in response to the input switching control signal 21 for four clocks. The second group includes the second, sixth, . . . , and $(4X\text{-}2)^{th}$ input switches SW2, SW6, . . . , and SW(4X-2) 12. One input switch 12 among the input switches SW2, SW6, . . . , and SW(4X-2) 12 is turned on in response to the input switching control signal 21 for four clocks. The third group includes the third, seventh, . . . , and $(4X\text{-}1)^{th}$ input switches SW3, SW7, . . . , and SW(4X-1) 12. One input switch 12 among the input switches SW3, SW7, . . . , and SW(4X-1) 12 is turned on in response to the input switching control signal 21 for four clocks. The fourth group includes the fourth, eighth, . . . , $4X^{th}$ input switches SW4, SW8, . . . , SW4X 12. One input switch 12 among the input switches SW4, SW8, . . . , and SW4X 12 is turned on in response to the input switching control signal 21 for four clocks.

The four D/A converters 13 are connected to in the four groups, respectively. That is, the first D/A converter 13 among the four D/A converters 13 is connected to the X input switches SW1, SW5, . . . , and SW(4X-3) 12 of the first group. The second D/A converter 13 is connected to the X input switches SW2, SW6, . . . , SW(4X-2) 12 of the second group. The third D/A converter 13 is connected to the X input switches SW3, SW7, . . . , and SW(4X-1) 12 of the third group. The fourth D/A converter 13 is connected to the X input switches SW4, SW8, . . . , and SW4X 12 of the fourth group. The first D/A converter 13 converts the display data 51 outputted from the latching section 11, which is connected to the one input switch 12 of the first group, into the output gradation voltage 52. The second D/A converter 13 converts the display data 51 outputted from the latching section 11, which is connected to the one input switch 12 of the second group, into the output gradation voltage 52. The third D/A converter 13 converts the display data 51 outputted from the latching section 11, which is connected to the foregoing one input switch 12 of the third group, into the output gradation voltage 52. The fourth D/A converter 13 converts the display data 51 outputted from the latching section 11, which is connected to the one input switch 12 of the fourth group, into the output gradation voltage 52.

Among the four amplifiers 14, the input of the first amplifier 14 is connected to the output of the first D/A converter 13, and the input of the second amplifier 14 is connected to the output of the second D/A converter 13. The input of the third amplifier 14 is connected to the output of the third D/A converter 13, and the input of the fourth amplifier 14 is connected to the output of the fourth D/A converter 13. The first amplifier 14 amplifies and outputs the output gradation voltage 52 from the first D/A converter 13, and the second amplifier 14 amplifies and outputs the output gradation voltage 52 from the second D/A converter 13. The third amplifier 14 amplifies and outputs the output gradation voltage 52 from the third D/A converter 13, and the fourth amplifier 14 amplifies and outputs the output gradation voltage 52 from the fourth D/A converter 13.

Among the four output switches SWO1 to SWO4 15, the output switch SWO1 15 as a first output switch 15 is provided between the output of the first amplifier 14 and a first output node OUT_P as the output node OUTm. The output switch SWO2 15 as a second output switch 15 is provided between the output of the second amplifier 14 and the first output node OUT_P. The output switch SWO3 15 as a third output switch 15 is provided between the output of the third amplifier 14 and a second output node OUT_N as the output node OUTm. The output switch SWO4 15 as a fourth output switch 15 is provided between the output of the fourth amplifier 14 and the second output node OUT_N. The output switch SWOK 15 (K=1, 2, 3, 4) as a one output switch 15 among the four output switches SWO1 to SWO4 15 is turned on in response to the output switching control signal 22 for one clock.

The selector circuit 16 connects the first output node OUT_P and a first node OUT1 so that the output switches SWO1 and SWO2 15 are applied to one of the positive drive and the negative drive and also connects the first output node OUT_P and a second node OUT2 so that the output switches SWO1 and SWO2 15 are applied to the other of the positive drive and the negative drive. The selector circuit 16 connects the second output node OUT_N and the second node OUT2 so that the output switches SWO3 and SWO4 15 are applied to one of them and also connects the second output node OUT_N and the second node OUT2 so that the output switches SWO3 and SWO4 15 are applied to drive the other of them.

The M data lines 41 are provided on the liquid crystal panel 40. Among the M data lines 41, the odd-numbered data lines 41 are connected to the first node OUT1. The even-numbered data lines 41 are connected to the second node OUT2.

As mentioned above, the M data line switches 44 are provided on the M data lines 41, respectively. One data line switch 44 among the M data line switches 44 is turned on in response to the data line switching control signal 23 for one clock.

The controller 20 is connected to the M input switches SW1, SW2, SW3, SW4, . . . , SW4X-3, SW4X-2, SW4X-1, and SW4X 12, the four output switches SWO1 to SWO4 15, and the M data line switches 44. The controller 20 sequentially supplies the M first to $M^{th}$ input switching control signals EN1, EN2, EN3, EN4, . . . , EN4X-3, EN4X-2, EN4X-1, and EN4X 21 to the M input switches SW1, SW2, SW3, SW4, . . . , SW4X-3, SW4X-2, SW4X-1, and SW4X 12, respectively. The controller 20 sequentially supplies the first to fourth output switching control signals PS1, PS2, NS1, and NS2 22 to the four output switches SWO1 to SWO4 15, respectively. The controller 20 sequentially supplies the first to $M^{th}$ data line switching control signals 23 to the M data line switches 44, respectively, in synchronization with the $Y^{th}$ clock of the input switching control signal 21.

According to the TFT type liquid crystal display apparatus according to the third embodiment of the present invention, the four D/A converters 13, the four amplifiers 14 and the four output switches 15 are provided for one output. The M (M=4X) latching sections 11 and the (4X) input switches 12 are grouped into the four groups. Thus, the output switches 15 switch the outputs of the amplifiers 14, in synchronization with the time-divisional period (of the output switching control signal 22). Also, when the switching period of the output switch 15 is assumed to be T, a period during which the D/A converter 13 inputs the display data 51 is assumed to be the period of (4×T), by advancing the phase by T/4 from the time-divisional period. That is, when the D/A converter 13 inputs the display data 51 in response to the input switching control signal 21 for the four clocks, the output gradation voltage 52 based on the display data 51 is outputted from the amplifier 14 at the fourth clock of the input switching control signal 21. Consequently, according to the TFT type liquid crystal display apparatus according to the third embodiment of the present invention, the high-speed drive can be attained without any influence of the D/A converter delay time (Td_DA). Also, the high-speed drive can be attained without any limit of the through rate when the amplifier 14 is driven.

According to the TFT type liquid crystal display apparatus according to the third embodiment of the present invention, the dot inversion drive can be also attained.

Although the present invention has been described above in connection with several embodiments thereof, it would be apparent to those skilled in the art that those embodiments are provided solely for illustrating the present invention, and should not be relied upon to construe the appended claims in a limiting sense.

What is claimed is:

1. A display apparatus comprising:

a display section;

M latching sections (M is a multiple of 3 or 2) configured to receive and hold display data to be displayed on said display section, wherein said M latching sections are grouped into Y latching section groups and each of said Y latching section groups comprises X of said M latching sections (Y is an integer equal to or more than 2 and X is an integer which meets M=X×Y);

M input switches respectively connected with outputs of said M latching sections, wherein said M input switches are grouped into Y switch groups, each of said Y input switch groups comprises X of said M input switches, and each of said X input switches of each of said Y input switch groups is turned on in response to an input switching control signal for Y clocks;

Y digital-to-analog (D/A) converters respectively connected with said Y input switch groups, wherein each of said Y D/A converters converts the display data held by each of said X latching sections of a corresponding one of said Y latching section groups into an output gradation voltage;

Y amplifiers configured to amplify and output the output gradation voltages from said Y D/A converters, respectively;

Y output switches provided between outputs of said Y amplifiers and an output node, respectively, wherein each of said Y output switches is turned on in response to an output switching control signal for one clock, and M data lines connected with the output node are provided on said display section;

M data line switches provided onto said M data lines, respectively, wherein each of said M data line switches is turned on in response to a data line switching control signal for one clock; and a control section configured to sequentially supply said M input switching control signals to said M input switches, sequentially supply said output switching control signals to said Y output switches, and sequentially supplies said M data line switching control signals to said M data line switches in synchronization with a $Y^{th}$ clock of said input switching control signal.

2. The display apparatus according to claim 1, wherein said display section is applied to a color display of primary colors of red, green and blue, and when M is a multiple of 3, X is 3 and Y is an integer equal to or more than 2.

3. The display apparatus according to claim 1, wherein said display section is applied to a color display of primary colors of red, green and blue, and when M is a multiple of 3, Y is 3 and X is an integer equal to or more than 2.

4. The display apparatus according to claim 1, wherein said display section is applied to a positive drive and a negative drive in a 2 dot inversion drive, when M is a multiple of 2, Y is 4 and X is an integer equal to or more than 2, first and second output switches of said Y output switches are applied to one of the positive drive and the negative drive, third and fourth output switches of said Y output switches are applied to the other of the positive drive and the negative drive.

5. A driver circuit comprising:

M latching sections (M is a multiple of 3 or 2) configured to receive and hold display data to be displayed on a display section, wherein said M latching sections are grouped into Y latching section groups and each of said Y latching section groups comprises X of said M latching sections (Y is an integer equal to or more than 2 and X is an integer which meets M=X×Y);

M input switches respectively connected with outputs of said M latching sections, wherein said M input switches are grouped into Y input switch groups, each of said Y input switch groups comprises X of said M input switches, and each of said X input switches of each of said Y input switch groups is turned on in response to an input switching control signal for Y clocks;

Y digital-to-analog (D/A) converters respectively connected with said Y input switch groups, wherein each of said Y D/A converters converts the display data held by each of said X latching sections of a corresponding one of said Y latching section groups into an output gradation voltage;

Y amplifiers configured to amplify and output the output gradation voltages from said Y D/A converters, respectively;

Y output switches provided between outputs of said Y amplifiers and an output node, respectively, wherein each of said Y output switches is turned on in response to an output switching control signal for one clock;

wherein M data lines connected with the output node are provided on said display section, and M data line switches are interposed between said M data lines and the output node, wherein each of said M data line switches is turned on in response to a data line switching control signal for one clock; and a control section configured to sequentially supply said M input switching control signals to said M input switches, sequentially supply said output switching control signals to said Y output switches, and sequentially supplies said M data line switching control signals to said M data line switches in synchronization with a $Y^{th}$ clock of said input switching control signal.

6. The driver circuit according to claim 5, wherein said display section is applied to a color display of primary colors of red, green and blue, and when M is a multiple of 3, X is 3 and Y is an integer equal to or more than 2.

7. The driver circuit according to claim 5, wherein said display section is applied to a color display of primary colors of red, green and blue, and when M is a multiple of 3, Y is 3 and X is an integer equal to or more than 2.

8. The driver circuit according to claim 5, wherein said display section is applied to a positive drive and a negative drive in a 2 dot inversion drive, when M is a multiple of 2, Y is 4 and X is an integer equal to or more than 2, first and second output switches of said Y output switches are applied to one of the positive drive and the negative drive, third and fourth output switches of said Y output switches are applied to the other of the positive drive and the negative drive.

* * * * *